US006929453B2

(12) United States Patent
Kite et al.

(10) Patent No.: US 6,929,453 B2
(45) Date of Patent: Aug. 16, 2005

(54) LOCKING SPACER ASSEMBLY FOR SLOTTED TURBINE COMPONENT

(75) Inventors: Edwin L. Kite, Stuart, FL (US); Brian Potter, Palm Beach Gardens, FL (US); Paul Matheny, Jupiter, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 24 days.

(21) Appl. No.: 10/733,737

(22) Filed: Dec. 11, 2003

(65) Prior Publication Data

US 2005/0129522 A1 Jun. 16, 2005

(51) Int. Cl.[7] ..... F01D 5/32
(52) U.S. Cl. ..... 416/220 R
(58) Field of Search ..... 416/220 R

(56) References Cited

U.S. PATENT DOCUMENTS

| | | | | |
|---|---|---|---|---|
| 2,916,257 | A * | 12/1959 | Poellmitz et al. | 416/220 R |
| 2,942,842 | A | 6/1960 | Hayes | |
| 3,198,485 | A | 8/1965 | Melenchuk | |
| 3,609,841 | A | 10/1971 | Telfer et al. | |
| 3,610,778 | A | 10/1971 | Suter | |
| 3,734,645 | A | 5/1973 | Strub | |
| 3,744,930 | A | 7/1973 | Carroll | |
| 3,813,185 | A | 5/1974 | Bouiller et al. | |
| 4,050,850 | A | 9/1977 | Beckershoff | |
| 4,080,101 | A | 3/1978 | Zlotek | |
| 4,221,542 | A | 9/1980 | Acres et al. | |
| 4,265,595 | A | 5/1981 | Bucy, Jr. et al. | |
| 4,462,756 | A | 7/1984 | Muggleworth et al. | |
| 4,676,723 | A | 6/1987 | Kiger et al. | |
| 4,684,325 | A | 8/1987 | Arnold | |
| 4,915,587 | A | 4/1990 | Pisz et al. | |
| 5,713,721 | A | 2/1998 | Glynn et al. | |
| 6,234,756 | B1 | 5/2001 | Ress, Jr. et al. | |
| 6,421,914 | B1 | 7/2002 | Iversen et al. | |
| 6,431,836 | B2 | 8/2002 | Zimmermann | |
| 6,464,463 | B2 | 10/2002 | Yvon Goga et al. | |
| 6,582,195 | B2 * | 6/2003 | Davidson | 416/198 A |
| 2002/0106279 | A1 | 8/2002 | Selby | |
| 2003/0049130 | A1 | 3/2003 | Miller | |

* cited by examiner

*Primary Examiner*—Ninh H. Nguyen

(57) ABSTRACT

Aspects according to the invention relate to a locking spacer assembly for a slotted turbine engine component. In one embodiment, aspects of the invention can be used in connection with the assembly and disassembly of a disc hosting a row of airfoils as can be found in the compressor or turbine section of a turbine engine. The spacer according to the invention is a multi-part assembly. In one embodiment, the spacer includes at least three sub-components: first and second end supports and a filler. The inner and outer faces of each of these components can have various features to facilitate engagement of the assembly and distribution of centrifugal loads in operation. These parts can be held together by a retainer, which can be received in a cutout provided in the end supports and the filler.

20 Claims, 7 Drawing Sheets

LOCKING SPACER ASSEMBLY FOR SLOTTED TURBINE COMPONENT

FIELD OF THE INVENTION

The invention relates in general to turbine engines and, more particularly, to spacer assemblies for filling voids in a slot of a turbine engine component.

BACKGROUND OF THE INVENTION

The compressor and turbine section of a turbine engine can include rotors with discs on which a plurality of blades are attached. The blades are arranged into one or more rows spaced axially along the rotor. The blades in each row are disposed about the periphery of the disc.

FIG. 1 shows a common system for attaching the blades 10 to a disc 12. The disc 12, which is shown in partial section, provides a slot or groove 14 extending about the periphery of the disc 12. The slot or groove 14 can have any of a number of configurations.

Each blade 10 has a root portion 17 at its base which is closely profiled to match the shape of the disc groove 14. Each blade 10 is retained by sliding the root 16 of the blade 10 into the disc groove 14. As a result of the close match in size and shape of the blade root 16 and rotor groove 14, motion of the blade 10 in the axial and radial direction is closely restrained. The slot 14 in the disc 12 permits a fan of blades 10 to be arranged about the periphery of the disc 12. The blades 10 are spaced apart peripherally and the resulting voids in the slot 14 between the roots 16 of adjacent blades 10 are filled with spacers 18.

The disc slot 14 typically provides a profile having lateral recesses 15 for receiving corresponding projections 17 of the attachment lugs 16 of the blades 10 and spacers 18. It is these substantially mating recesses 15 and projections 17 that secure the blades 10 and spacers 18 axially and radially. Because of the projections 17, the attachment lugs 16 of the blades 10 and spacers 18 cannot be directly inserted into the slot 14 in their operational orientation. Instead, the root portion 16 of these components must first be inserted sideways, with the projections 17 extending along the slot 14 and then rotated to the final orientation with the projections 17 extending into the lateral recesses 15.

As blades 10 and spacers 18 are installed in the slot 14, the remaining space in the slot 14 permits the next blade 10 or spacer 18 to be installed as discussed above. However, when the blade 10 and spacer 18 array is near complete installation, there is not sufficient space remaining in the slot 14 to permit insertion and rotation of the final spacer 18. To address this space constraint, multipart spacers have been developed that can be installed in pieces without the need to rotate into final position. Typically, two end supports are positioned into mating engagements with the recessed sides of the slot and a filler piece is interposed between the end supports. However, under the great centrifugal forces encountered during operation of the turbine, these multipart spacers can come apart and dislodge, causing extensive damage to the turbine engine.

SUMMARY OF THE INVENTION

Thus, one object according to aspects of the present invention is to provide a spacer assembly that facilitates installation and removal of the spacer assembly for construction and repair of turbine blade fans. It is another object of the invention to provide a spacer assembly that securely locks into place and is highly resistant to disassembly and dislodgement under high centrifugal forces during turbine operation. These and other objects according to aspects of the present invention are addressed below.

In one respect, aspects of the invention relate to a locking spacer assembly for filling a void in a turbine component slot having lateral recesses. The locking spacer assembly includes first and second end supports. The first and second end supports each have an outer face and an opposing inner face. Each outer face has an outwardly stepped profile. Thus, the first and second end supports are adapted to be inserted in a turbine component slot having lateral recesses and to project into the lateral recesses. The inner faces face toward each other and are spaced apart.

The locking spacer assembly further includes a filler assembly disposed between the inner faces of the first and second end supports. The filler assembly includes first and second outer fillers and a central filler. Each of the inner faces of the end supports has an inset. The first outer filler has a projection that extends into the inset of one of the inner faces, and the second outer filler has a projection that extends into the inset of the other inner face. The central filler is disposed between the first and second outer fillers.

Each outer face of the end supports can extend from an upper end to a lower end. The stepped profile of each outer face can include a lower projection adjacent the lower end. The stepped profile can further include an upper projection adjacent the upper end. The upper projection can be tapered.

Each inner face inset can substantially mate with a respective one of the outer filler projections. In one embodiment, each outer filler projection can include a step, and each inner face inset can be a stepped recess for matingly receiving a respective one of the steps. In another embodiment, each outer filler projection can include a series of filler teeth, and each inner face inset can include a series of inner face teeth for matingly engaging a respective one of the series of filler teeth. Each of the filler teeth and inner face teeth can have a sawtooth profile.

The assembly can further include a retainer having a curved retainer base. In such case, each of the first and second end supports, the first and second outer fillers and the central filler can have a cutout for collectively receiving the curved retainer base. The curved retainer base can have a concave top, and the retainer can include a retainer web at least partially spanning the concave top. At least the respective cutouts of the first and second outer fillers and the central filler can collectively receive the retainer web. The respective cutouts of the first and second end supports can also collectively receive the retainer web. Each of the respective cutouts can be provided in an upper surface of each of the first and second end supports, the first and second outer fillers and the central filler.

In another respect, aspects of the invention relate to a locking spacer assembly for filling a void in a turbine component slot having lateral recesses that uses a curved retainer. The locking spacer assembly includes first and second end supports. Each of the first and second end supports has an outward face and an opposing inner face. Each outward face has an outwardly stepped profile. Thus, the first and second end supports are adapted to insert in a turbine component slot having lateral recesses and to project into the lateral recesses. The inner faces face toward each other. The assembly further includes a retainer having a curved retainer base. Each of the first and second end supports has a cutout for collectively receiving the curved retainer base.

The assembly can further include at least one filler disposed between the inner faces. The filler can provide a cutout for receiving, collectively with the cutouts of the first and second end supports, the curved retainer base. The curved retainer base can have a concave top, and the retainer can include a retainer web that at least partially spans the concave top. At least the cutout of the filler can receive the retainer web. The respective cutouts of the first and second end supports can receive, collectively with the cutout of the filler, the retainer web.

In yet another respect, aspects of the invention relate to a slotted turbine component with a locking spacer assembly for filling a void in the slot turbine component slot. The turbine component has slot, and the slot has a profile that includes a central opening and at least one recess extending laterally from each side of the central opening. The locking spacer assembly includes first and second end supports. The first and second end supports each have an outward face and an opposing inner face. Each outward face has a projection that extends into a respective one of the slot recesses. The inner faces face toward each other. The locking spacer assembly further includes a retainer having a curved retainer base.

Each of the first and second end supports has a cutout for collectively receiving the curved retainer base. The locking spacer assembly further includes a filler assembly disposed between the inner faces of the first and second end supports. The filler assembly includes first and second outer fillers and a central filler. Each of the inner faces of the first and second end supports has an inset. The first outer filler has a projection that extends into the inset of one of the inner faces; the second outer filler has a projection that extends into the inset of the other inner face. The central filler is disposed between the first and second outer fillers.

The slotted turbine component with locking spacer assembly can further include at least one filler disposed between the inner faces. The filler can provide a cutout for receiving, collectively with the cutouts of the first and second end supports, the curved retainer base. The curved retainer base can have a concave top. The retainer can include a retainer web that at least partially spans the concave top. At least the cutout of the filler can receive the retainer web. The respective cutouts of the first and second end supports can receive, collectively with the cutout of the filler, the retainer web.

DETAILED DESCRIPTION OF EMBODIMENTS OF THE INVENTION

Aspects of the present invention relate to spacer assemblies for filling a void in a slotted turbine engine component. The following detailed description is directed to various embodiments of spacer assemblies according to aspects of the invention, presented in the context of slotted turbine blade or compressor discs, but the features disclosed herein can be applied to other slotted turbine engine components. The present invention is not limited to the illustrated structure or application, and the following detailed description is intended only as exemplary.

Aspects of the invention can be applied to a variety of turbine engine systems. A turbine engine can generally include a compressor section, a combustor section and a turbine section. Each of these sections can have a variety of components and configurations as would be appreciated by one skilled in the art. For example, the compressor section can include a rotor on which a plurality of discs are attached. The discs are generally circular components having a circumferential groove extending about the periphery or circumference of the disc. The groove can have any of a number of configurations and aspects of the invention are not limited to any particular disc or slot shape or configuration.

Figure 1:
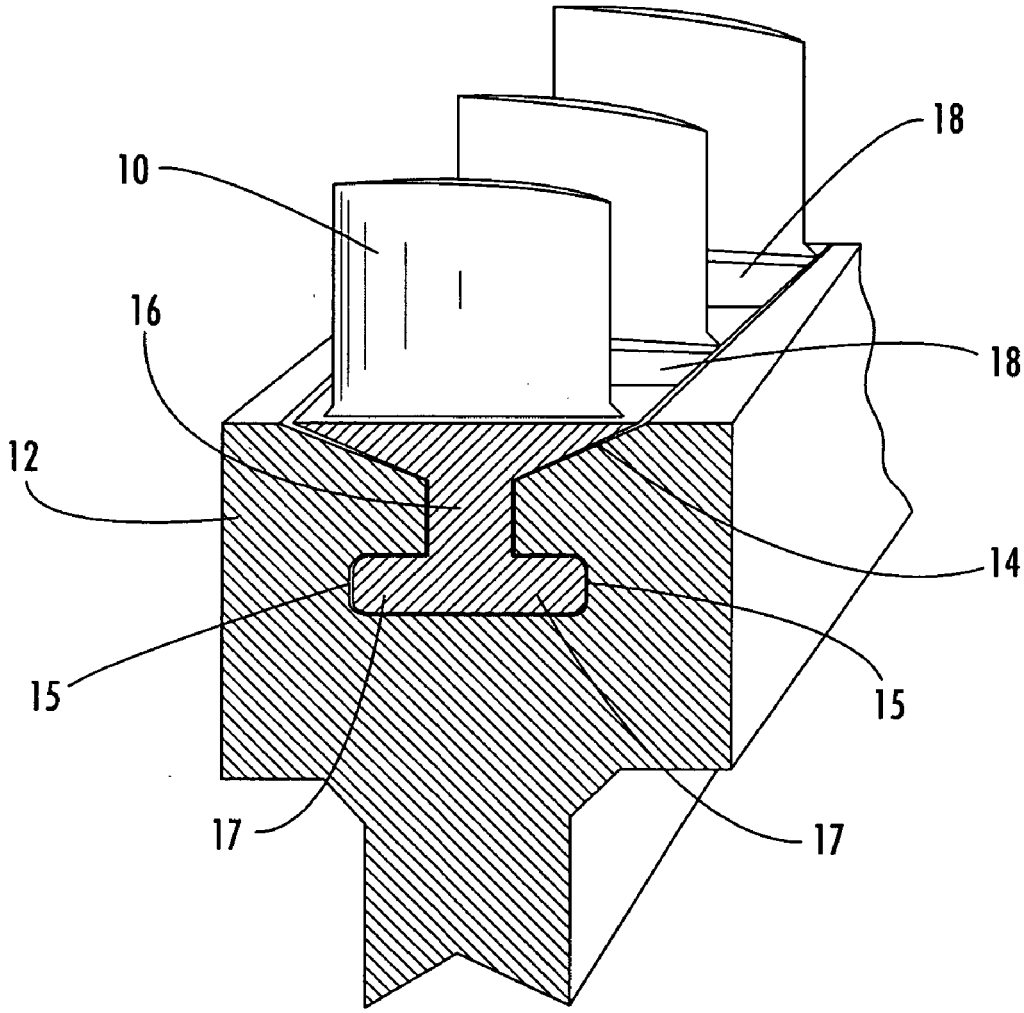
FIG. 1 (PRIOR ART)
FIG. 1 is a partial sectional view of the general arrangement of a disc slot and associated blade roots and spacers.
Figure 2A:
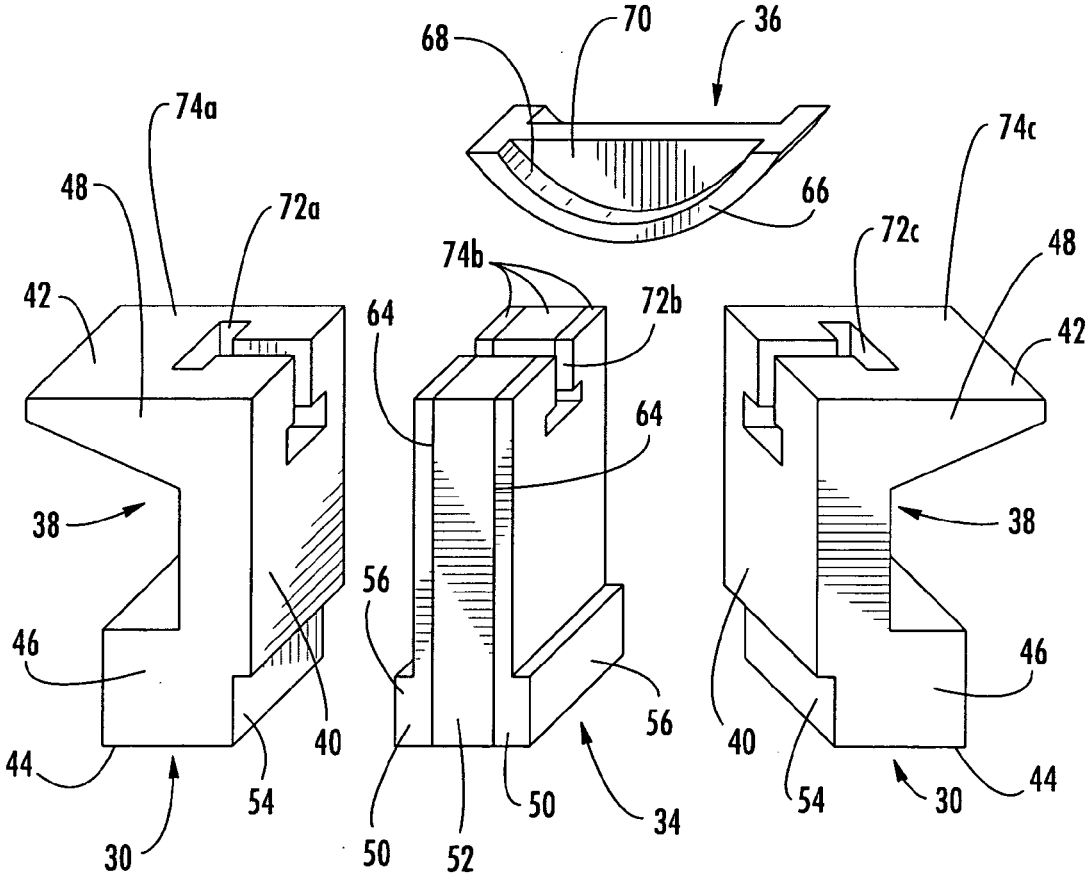
FIG. 2A is an isometric exploded view of a first spacer assembly according to aspects of the invention.
Figure 2B:
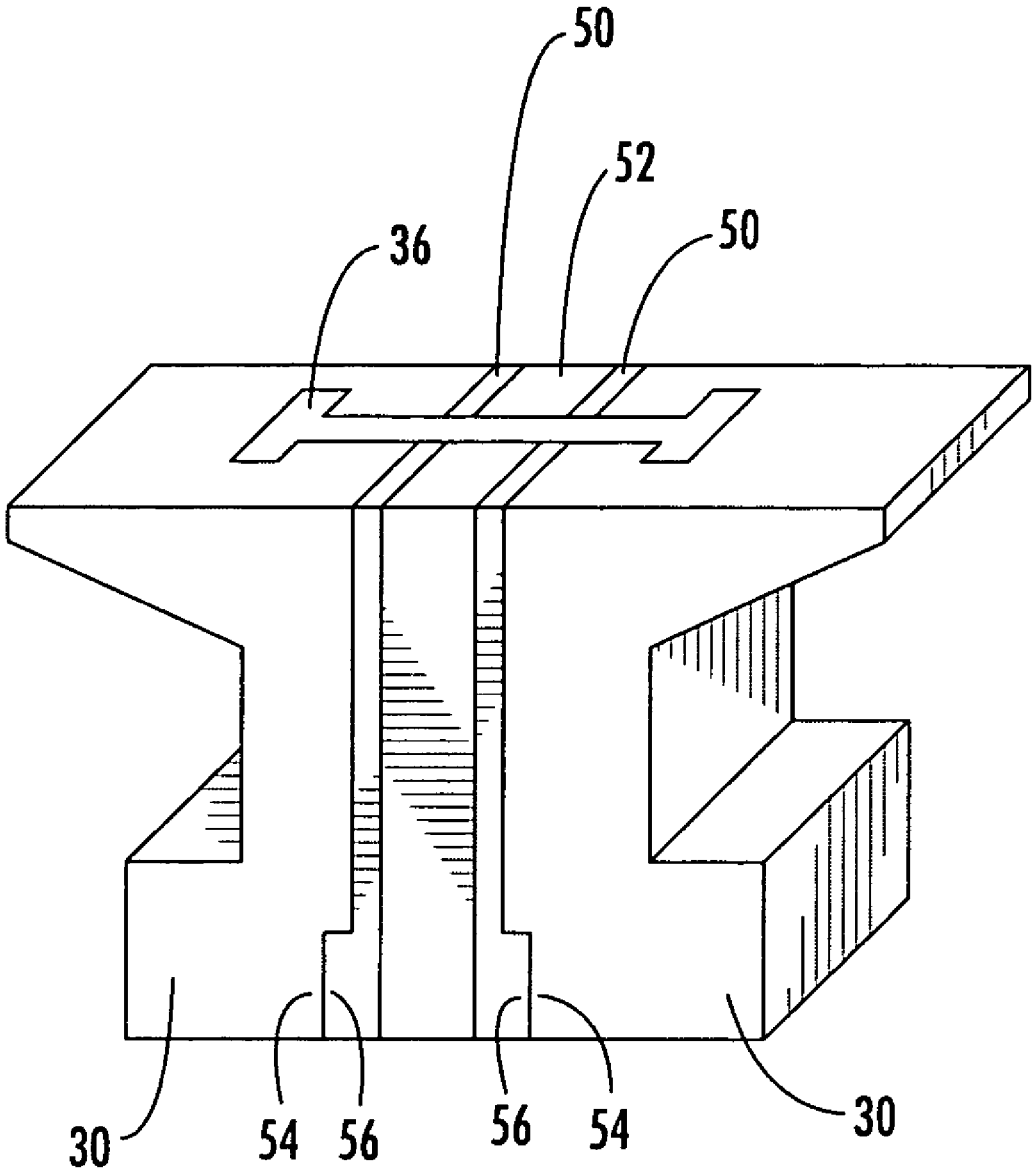
FIG. 2B is an isometric view of the first spacer assembly according to aspects of the invention.
Figure 2C:
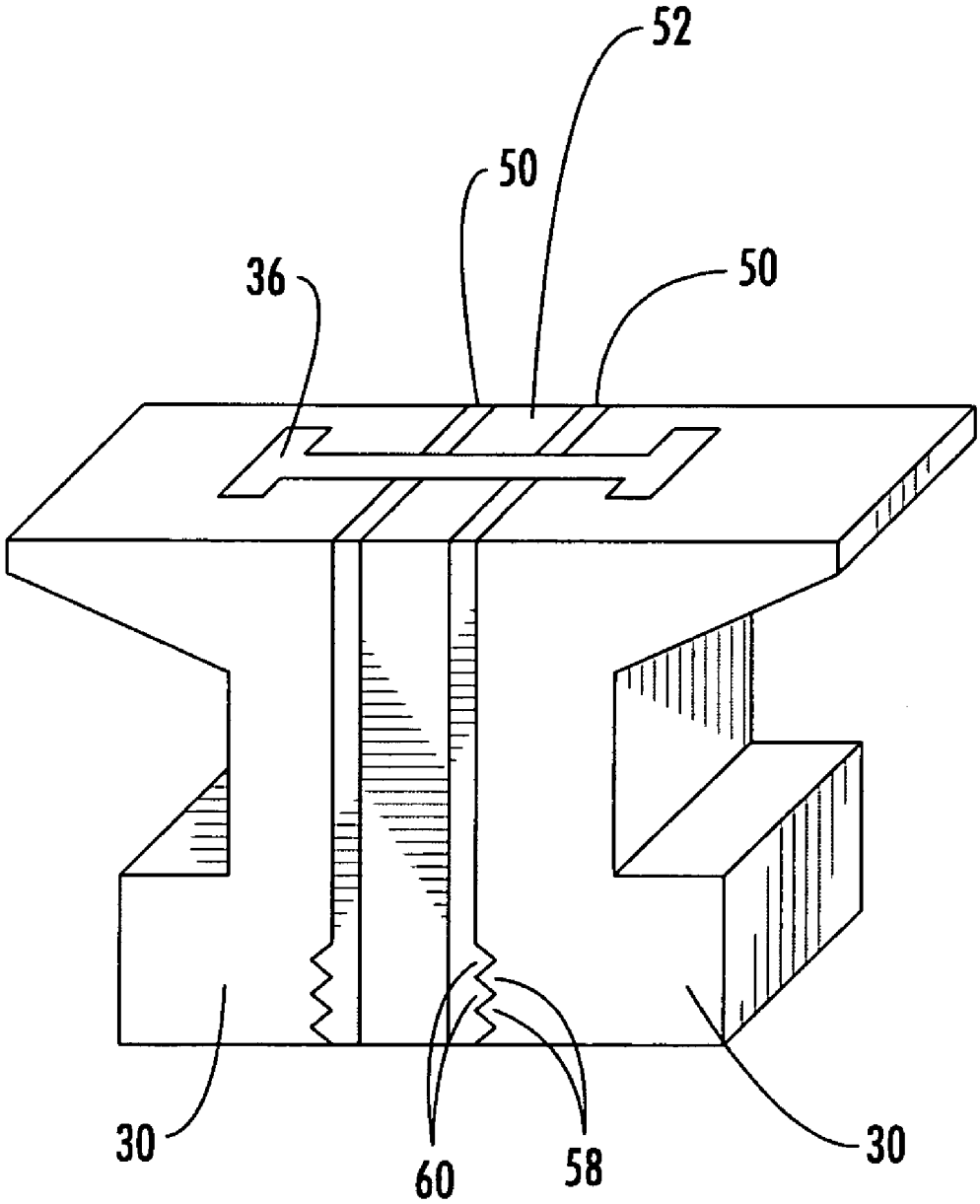
FIG. 2C is an isometric view of an alternative embodiment of the first spacer assembly according to aspects of the invention.

Referring to FIGS. 2A–2C, a spacer assembly for filling a void in a turbine component channel or slot is shown. One embodiment of a spacer assembly can include a pair of end supports 30, a filler 34 and a retainer 36. The end supports 30, filler 34 and retainer 36 are separate to allow individual insertion in the slot of a turbine component, such as a compressor blade disc, having lateral recesses (see generally FIG. 1).

Each of the end supports 30 provides an outer face 38 and an inner face 40. Each outer face 38 can provide a stepped profile extending from an upper end 42 to a lower end 44. This stepped profile is preferably designed to closely match the corresponding lateral profiles of the disc slot into which the spacer is installed. Preferably, the outer face profile substantially mates with the lateral profiles of the disc slot, but a sufficient correspondence of size and shape to secure the spacer assembly in the slot can be sufficient.

The stepped profile of each end support 30 can include a projection 46, such as a step adjacent a lower end 44 for extension into a corresponding recess in the disc slot. Other projection geometries are also possible, provided the projection secures the end support in the disc slot when the spacer assembly is fully installed. The stepped profile can also include an upper projection 48 for engaging a corresponding surface in the lateral profiles of a disc slot. The upper projection 48 is preferably tapered, again to match the disc slot lateral profiles.

During installation and when finally assembled, the inner faces 40 of the end supports 30 face each other. When a filler 34 is used, the inner faces 40 are spaced apart and the filler 34 is positioned between the inner faces 40.

The filler 34 can be a single piece, such as a flat plate, for filling the gap between the inner faces 40 of the end supports 30. Preferably, the filler 34 is an assembly including at least three parts: a central filler 52 and two outer fillers 50. The two outer fillers 50 are preferably constructed to engage the inner faces 40 of the support ends 30. For example, each of the inner faces 40 of the end supports 50 can have an inset. In such case, the first outer filler 50 can have a projection 56 extending into the inset of one of the inner faces 40, and the second outer filler 50 can have a projection extending into the inset of the other inner face 40. Each inner face inset can substantially mate with a respective one of the outer filler projections.

The inset can be any of a number of shapes and configurations. For instance, the inset can include at least one stepped recess 54, as shown in FIG. 2A. The outer filler projection can include a step 56 that can be matingly received in a respective one of the stepped recesses 54. This configuration, shown in FIG. 2B, is particularly suited for applications in which lower loads are expected.

Alternatively, each the inner face inset can include a series of inner face teeth 58. Correspondingly, each outer filler projection can include a series of filler teeth 60, which can matingly engage a respect one of the series of inner face teeth 58. Such a configuration is well suited for higher loads. Each of the filler teeth 60 and the inner face teeth 58 can have various conformations. In one embodiment, the teeth can have a substantially sawtooth profile, as shown in FIG. 2C. In another embodiment, the teeth can have a substantially square-tooth profile (not shown).

In addition to the above, the outer filler projection and the inner face inset can be almost any substantially matingly shaped or correspondingly shaped combination, and aspects of the invention are not limited to any particular shape. Further, in any spacer assembly, the conformation of the teeth on one set of matingly engaged inner face teeth and filler teeth can be different from the other set of matingly engaged inner face teeth and filler teeth in the assembly.

The central filler 52 preferably has substantially flat outer sides 64. The central filler 52 can be any shape so that it can be inserted directly into the gap between the outer fillers 50 so as to close the gap. In one embodiment, the central filler 52 is substantially rectangular.

The retainer 36 can have at least a curved base 66. The curved retainer base 66 can be significant in counteracting centrifugal forces acting on the disc or other slotted turbine component. Each of the first and second end supports 30, the first and second outer fillers 50 and the central filler 52 can have a cutout 72*a*,72*b*,72*c* for collectively receiving the curved retainer base 66. The curved retainer base 66 can have a concave top 68 and the retainer 36 can include a retainer web 70 at least partially spanning the concave top 68. At least the respective cutouts 72*b* of the first and second outer fillers 50 and the central filler 52 can collectively receive the retainer web 70. Preferably, each of the respective cutouts 72*a*,72*b*,72*c* can be provided in an upper surface 74*a*,74*b*,74*c* of each of the first and second end supports 30, the first and second outer fillers 50 and the central filler 52. The retainer 36 configuration shown in FIGS. 2A–2C is well suited for higher loads.

The end supports 30, the filler 34 and the retainer 36 can be made of a variety of materials. Preferably, all of these components are made from the same material such as steel. The individual components can be made by any of a variety of processes such as casting, welding, and machining to name a few.

Figure 3A:
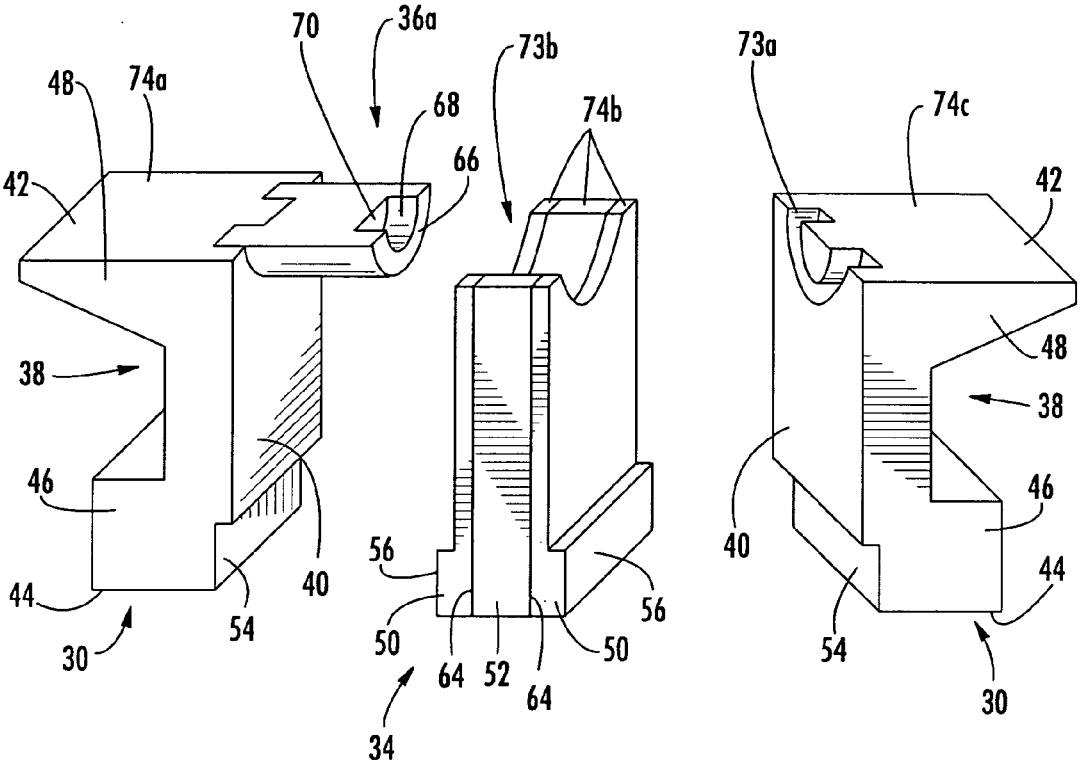
FIG. 3A is an isometric exploded view of a second spacer assembly according to aspects of the invention.
Figure 3B:
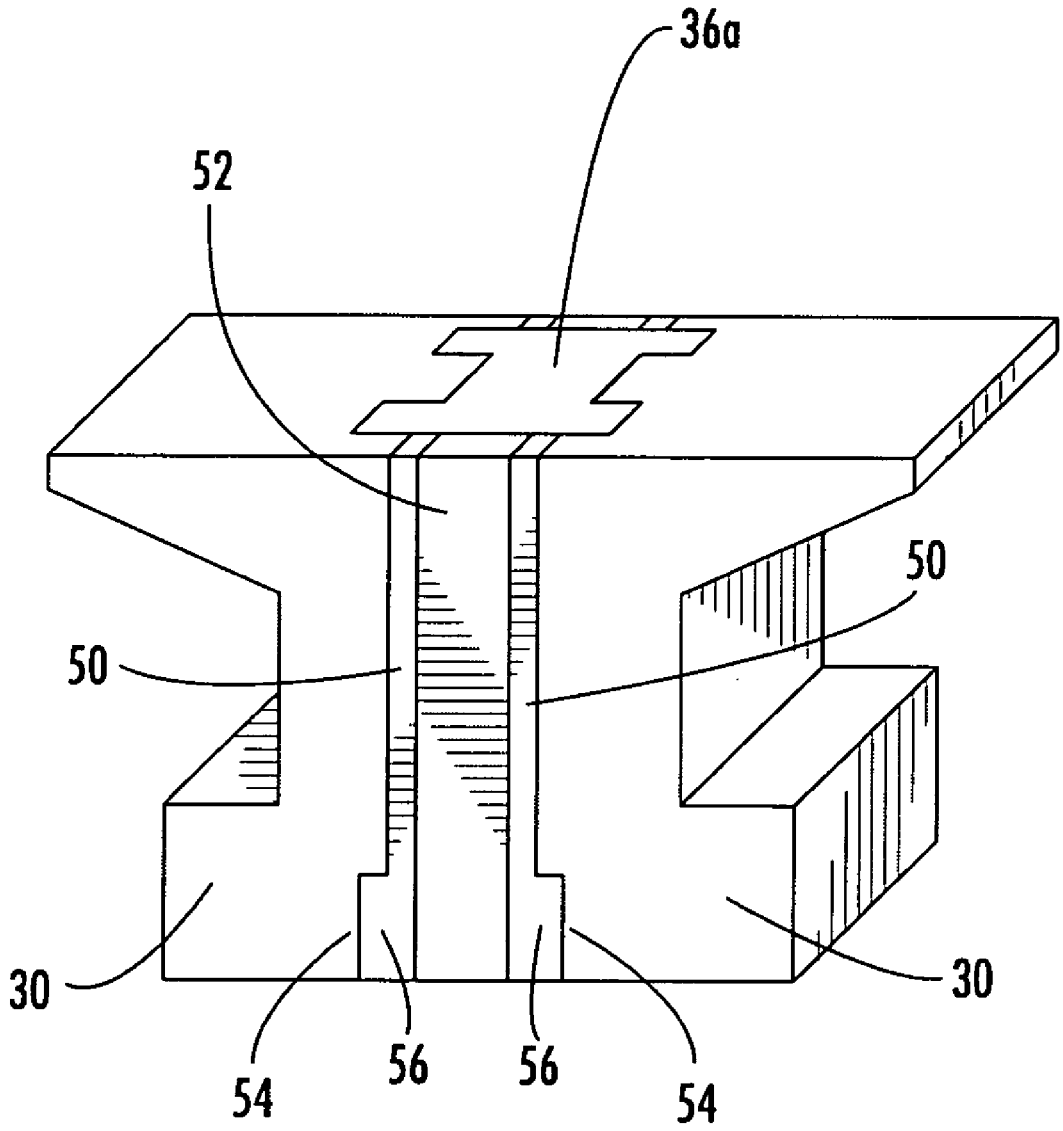
FIG. 3B is an isometric view of the second spacer assembly according to aspects of the invention.
Figure 3C:
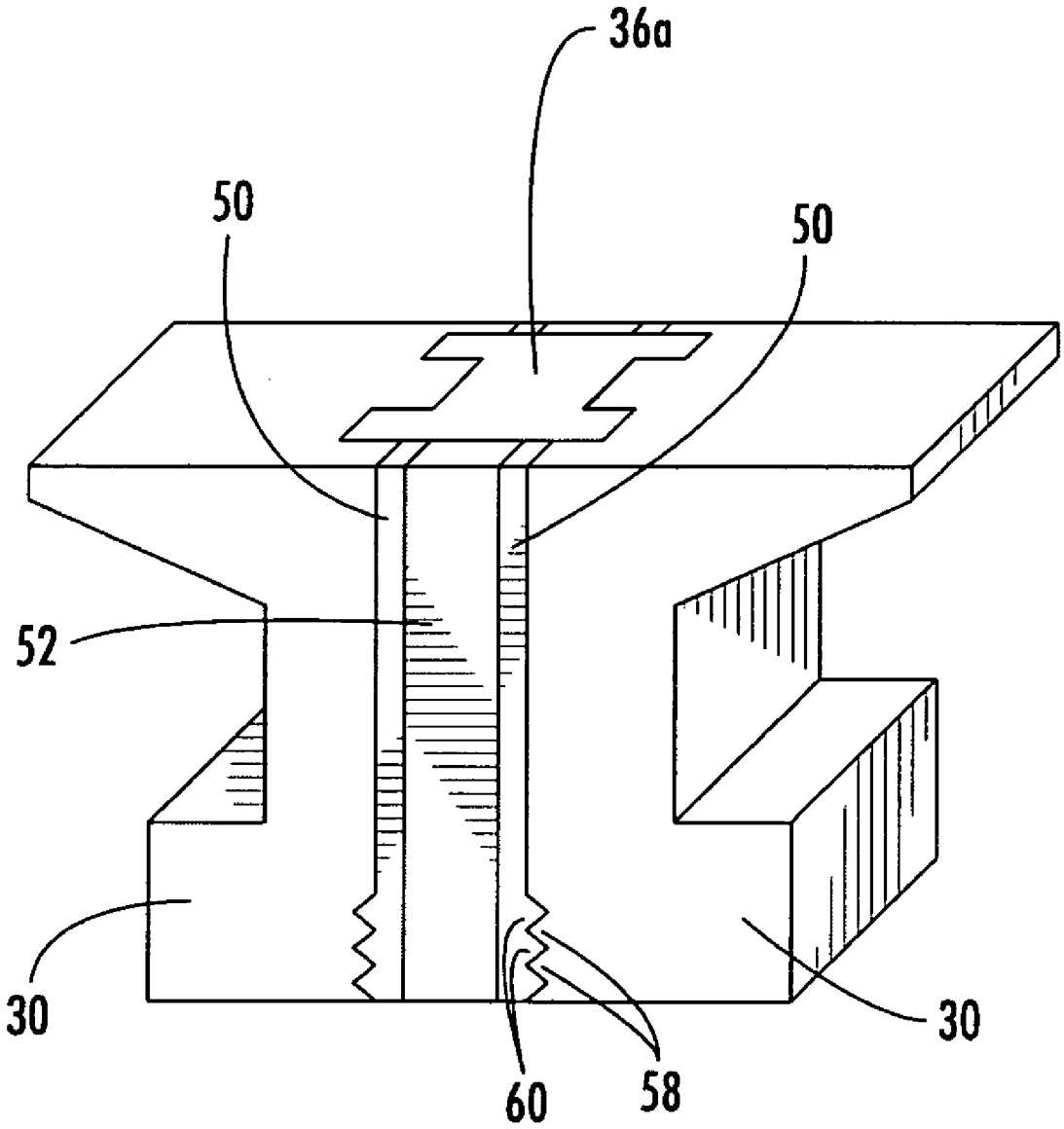
FIG. 3C is an isometric view of an alternative embodiment of the second spacer assembly according to aspects of the invention.

Additional spacer assemblies according to aspects of the invention are shown in FIGS. 3A–3C. The individual components of these assemblies are substantially identical to the spacer assemblies shown in FIGS. 2A–2C. However, the retainer 36*a* is oriented substantially 90 degrees in comparison to the previous retainer 36 orientation. Such a retainer 36*a* configuration is well suited for operating conditions in which lower loads are expected. Such a configuration can also reduce manufacturing costs associated with the spacer assembly at least because, in these embodiments, complicated features do not have to be made in the filler 34 to receiver the retainer web 70.

A lock spacer assembly, configured in any of the various ways described above, can be used in methods according to aspects of the invention so as to facilitate installation and removal of one or more components from a slotted turbine component such as a compressor disc. The method described herein is merely an example as not every step described need occur and, similarly, the steps described are not limited to performance in the sequence described.

First, a turbine engine component is provided such as a compressor or turbine disc (such as the disc 12 generally shown in FIG. 1). The component can have a slot 14 having lateral recesses 15. Any of the above described lock spacer assemblies can be used to fill at least a portion of the void in the slot 14. One of the end supports 30 can be inserted in the slot 14. The end support 30 can be positioned such that the outer face 38 of the end support 30 projects into the lateral recesses 15 in the slot 14. Similarly, the other end support 30 can be inserted and positioned in the slot 14. Once both end supports 30 are positioned, the inner faces 40 of the end supports 30 can face toward each other and can be spaced apart so as to define a gap.

The gap between the inner faces 40 of the end supports 30 can be closed by using a filler 34, which, for purposes of this example, is a three part assembly. In particular, the filler 34 can comprise two outer fillers 50 and a central filler 52. One of the outer fillers 50 can be inserted into the gap defined between the inner faces 40 of the end supports 30. The outer filler 50 can then be positioned so as to be substantially adjacent to the inner face 40 of a respective one of the end supports 30. When in position, a projection 56 on the first outer filler 50 can extend into an inset 54 on the inner face 40 of the respective end support 30. Likewise, the other outer filler 50 can be inserted into the space or gap, now defined between the inner face of the first outer filler 50 and the inner face 40 of the other end support 30. The other outer filler 50 can then be positioned so as to be substantially adjacent to the inner face 40 of the other end support 30 such that a projection 56 on the other outer filler 50 can extend into an inset 54 on the inner face 40 of the respective other end support 30.

Once the two outer fillers 50 are positioned, a gap remains between the inner faces of the two outer fillers 50, which face each other and are spaced apart. The gap can be closed by inserting a central filler 52 into the gap. The central filler 52 can have at least two opposing sides 52 that correspond to the geometry of the inner faces of the outer fillers 50. Preferably, the inner faces of the two outer fillers 50 are substantially flat. In such case, the central filler 52 can have two opposing substantially flat surfaces 64. For example, the central filler 52 can be substantially rectangular. Such a configuration is advantageous because it allows the central filler 52 to be inserted directly into the gap without the need for turning or other additional steps in the installation technique.

Once the parts of the spacer assembly are in place as described above, a retainer 36 can be inserted into the aligned cutouts 72*a*,72*b*,72*c* in the spacer assembly so as to lock the components together. The top of the retainer 36 can be hammered or tack welded to the top 74*a*,74*b*,74*c* of the spacer assembly to provide additional securement.

In the context of a compressor disc, only one or possibly two spacer assemblies according to aspects of the invention are needed. Additional spacers can be used if desired, but known single piece spacers can be used and the prior turning technique can be employed when installing such spacers.

Again, aspects of the invention can have application to a variety of areas and components in a turbine engine. As discussed above, aspects of the invention can be used in connection with the assembly and/or disassembly of a disc in the compressor section of the engine. Similarly, aspects of the invention can be applied to the assembly and/or disassembly of a disc in the turbine section of the engine. Further, aspects of the invention are not limited to the rotating components of a turbine engine as they can be applied to the stationary components as well such as in connection with the installation and/or removal of stators. It will of course be understood that the invention is not limited to the specific details described herein, which are given by way of example only, and that various modifications and alterations are possible within the scope of the invention as defined in the following claims.

What is claimed is:

1. A locking spacer assembly for filling a void in a turbine component slot having lateral recesses, said locking spacer assembly comprising:

first and second end supports, said first and second end supports each having an outer face and an opposing inner face, each outer face having an outwardly stepped profile, whereby said first and second end supports are adapted to insert in a turbine component slot having lateral recesses and to project into the lateral recesses, said inner faces facing toward each other and spaced apart; and a filler assembly disposed between the inner faces of the first and second end supports, said filler assembly including first and second outer fillers and a central filler, each of the inner faces having an inset, said first outer filler having a projection extending into the inset of one of the inner faces and the second outer filler having projection extending into the inset of the other inner face, said central filler being disposed between the first and second outer fillers.

2. The assembly of claim 1 wherein each outer face extends from an upper end to a lower end, and the stepped profile of each outer face includes a lower projection adjacent said lower end.

3. The assembly of claim 2 wherein the stepped profile further includes an upper projection adjacent said upper end.

4. The assembly of claim 3 wherein the upper projection is tapered.

5. The assembly of claim 1 wherein each inner face inset substantially mates with a respective one of the outer filler projections.

6. The assembly of claim 5 wherein each outer filler projection includes a step and each inner face inset is a stepped recess for matingly receiving a respective one of said steps.

7. The assembly of claim 5 wherein each outer filler projection includes a series of filler teeth and each inner face inset includes a series of inner face teeth for matingly engaging a respective one of the series of filler teeth.

8. The assembly of claim 7 wherein each of the filler teeth and inner face teeth has a sawtooth profile.

9. The assembly of claim 1 further comprising a retainer having a curved retainer base, each of said first and second end supports, said first and second outer fillers and said central filler having a cutout for collectively receiving the curved retainer base.

10. The assembly of claim 9 wherein the curved retainer base has a concave top and the retainer includes a retainer web at least partially spanning the concave top and wherein at least the respective cutouts of said first and second outer fillers and said central filler collectively receive the retainer web.

11. The assembly of claim 10 wherein the respective cutouts of the first and second end supports collectively receive the retainer web.

12. The assembly of claim 9 wherein each of the respective cutouts is provided in an upper surface of each of said first and second end supports, said first and second outer fillers and said central filler.

13. A locking spacer assembly for filling a void in a turbine component slot having lateral recesses, said locking spacer assembly comprising:

first and second end supports, said first and second end supports each having an outward face and an opposing inner face, each outward face having an outwardly stepped profile, whereby said first and second end supports are adapted to insert in a turbine component slot having lateral recesses and to project into the lateral recesses, said inner faces facing toward each other; and a retainer having a curved retainer base, each of said first and second end supports having a cutout for collectively receiving the curved retainer base.

14. The assembly of claim 13 further comprising at least one filler disposed between said inner faces, said filler providing a cutout for receiving, collectively with the cutouts of the first and second end supports, the curved retainer base.

15. The assembly of claim 14 wherein the curved retainer base has a concave top and the retainer includes a retainer web at least partially spanning the concave top and wherein at least the cutout of the filler receives the retainer web.

16. The assembly of claim 14 wherein the respective cutouts of the first and second end supports receive, collectively with the cutout of the filler, the retainer web.

17. A slotted turbine component with a locking spacer assembly for filling a void in the turbine component slot comprising:

a turbine component having slot, said slot having a profile including a central opening and at least one recess extending laterally from each side of the central opening;

first and second end supports, said first and second end supports each having an outward face and an opposing inner face, each outward face having a projection extending into a respective one of the slot recesses, said inner faces facing toward each other; and a retainer having a curved retainer base, each of said first and second end supports having a cutout for collectively receiving the curved retainer base;

a filler assembly disposed between the inner faces of the first and second end supports, said filler assembly including first and second outer fillers and a central filler, each of the inner faces having an inset, said first outer filler having a projection extending into the inset of one of the inner faces and the second outer filler having a projection extending into the inset of the other inner face, said central filler being disposed between the first and second outer fillers.

18. The slotted turbine component with locking spacer assembly of claim 17 further comprising at least one filler disposed between said inner faces, said filler providing a cutout for receiving, collectively with the cutouts of the first and second end supports, the curved retainer base.

19. The assembly of claim 18 wherein the curved retainer base has a concave top and the retainer includes a retainer web at least partially spanning the concave top and wherein at least the cutout of the filler receives the retainer web.

20. The assembly of claim 19 wherein the respective cutouts of the first and second end supports receive, collectively with the cutout of the filler, the retainer web.

* * * * *